US011209756B2

(12) United States Patent
Chimoto et al.

(10) Patent No.: US 11,209,756 B2
(45) Date of Patent: Dec. 28, 2021

(54) METHOD FOR PRODUCING PRINTED MATTER

(71) Applicant: CANON KABUSHIKI KAISHA, Tokyo (JP)

(72) Inventors: Yuya Chimoto, Funabashi (JP); Yoshiro Tsukada, Nagareyama (JP); Naoyuki Yamamoto, Nagareyama (JP); Shuichi Tamura, Moriya (JP); Akifumi Matsubara, Kashiwa (JP); Hayato Ida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/985,367

(22) Filed: Aug. 5, 2020

(65) Prior Publication Data

US 2021/0063921 A1 Mar. 4, 2021

(30) Foreign Application Priority Data

Aug. 30, 2019 (JP) ..... JP2019-158136

(51) Int. Cl.
*G03G 15/20* (2006.01)
*G03G 9/087* (2006.01)

(52) U.S. Cl.
CPC ..... *G03G 15/2014* (2013.01); *G03G 9/08755* (2013.01); *G03G 9/08782* (2013.01)

(58) Field of Classification Search
CPC ..... G03G 15/2014; G03G 9/08755; G03G 9/08782
See application file for complete search history.

(56) References Cited

U.S. PATENT DOCUMENTS

| | | | | |
|---|---|---|---|---|
| 8,630,573 | B2 | 1/2014 | Iio et al. | |
| 2016/0103401 | A1 * | 4/2016 | Kanno | G03G 9/08797 399/130 |

FOREIGN PATENT DOCUMENTS

| | | | | |
|---|---|---|---|---|
| JP | 2011-191536 | A | 9/2011 | |
| JP | 2012-078565 | A | 4/2012 | |
| JP | 2020008818 | A * | 1/2020 | |
| WO | WO-2012036311 | A1 * | 3/2012 | G03G 9/08795 |

* cited by examiner

*Primary Examiner* — Ryan D Walsh
(74) *Attorney, Agent, or Firm* — Venable LLP

(57) ABSTRACT

A method for producing printed matter that has a fixed toner image and a resin layer, in the indicated sequence, on a substrate, comprising a toner image formation step of forming a fixed toner image on the substrate by fixing a toner containing a resin and a hydrocarbon wax, a mixture layer formation step of forming, on the fixed toner image, a layer of a mixture, the mixture contains at least one selected from the group consisting of diacrylates and dimethacrylates as a component (a) and a polymerization initiator as a component (b); and a resin layer formation step of polymerizing the component (a) and the component (b) in the mixture layer to form the resin layer; wherein the melting point of the hydrocarbon wax is from 55° C. to 85° C., a surface wax index A and a wax distribution unevenness index B of the area are predetermined range.

12 Claims, No Drawings

METHOD FOR PRODUCING PRINTED MATTER

BACKGROUND OF THE INVENTION

Field of the Invention

The present disclosure relates to a method for producing the printed matter provided by the execution of postprocessing, e.g., varnish coating and so forth, on a toner image formed using an electrophotographic system, e.g., el ectrophotography, electrostatic recording, electrostatic printing, and so forth.

Description of the Related Art

The growth and development of image-forming devices such as copiers and printers has been accompanied in recent years by the desire for electrophotographic system-based image-forming devices that can support the production printing market. High-quality images that can accommodate a wide variety of applications are required in the production printing market. One example of this is the execution of a varnish coating over all or part of an electrophotographic image with the goal of enhancing the image quality and durability.

However, the following problems, for example, are known to occur when a varnish coating is executed on an image formed by an electrophotographic system-based image-forming device: the image may repel the varnish and a satisfactory coating film is then not obtained; the varnish may not be repelled, but the adherence between the image and the varnish is unsatisfactory and exfoliation readily occurs.

It is known that a principal cause of these problems is the release agent that separates to the image surface during thermal fixing. Release agents are widely used with electrophotographic system-based image-forming devices in order to improve the offset resistance and separation performance. However, in addition to these properties, release agents exhibit a low interaction with varnishes, and this is a factor that reduces the adherence between the varnish and image.

To respond to these problems, for example, through the use of a polar wax as the release agent in accordance with Japanese Patent Application Laid-open No. 2012-78565 and Japanese Patent Application Laid-open No. 2011-191536, the affinity of the release agent for the varnish is improved and the coatability and adherence by the varnish are then improved.

SUMMARY OF THE INVENTION

While the adherence with the varnish is improved when the amount of release agent is reduced in order to address the aforementioned problems, the separation performance at low temperatures in the toner image formation step is also reduced. In addition, with regard to the art in the aforementioned patent literature, it has been found that, while the resin/release agent interaction is increased, the release effect from the release agent is lost as a result and the separation performance at low temperatures is reduced.

The present disclosure provides a method for producing printed matter that exhibits an excellent low-temperature separation performance during the toner image formation step and an excellent adherence between the varnish and toner image after the execution of a varnish coating.

As a result of intensive investigations, the present inventors found that printed matter that exhibits an excellent low-temperature separation performance during the toner image formation step and an excellent adherence between the varnish and toner image after the execution of a varnish coating, is obtained by forming a toner image in which a hydrocarbon wax is distributed in a prescribed amount and with a prescribed degree of distribution unevenness, and by forming, on the toner image, a varnish layer that has a prescribed structure.

That is, the present disclosure is a method for producing printed matter that has a fixed toner image and a resin layer, in the indicated sequence, on a substrate, the fixed toner image including an area whose toner laid-on level is at least 0.2 mg/cm$^2$, comprising:

a toner image formation step of forming a fixed toner image on the substrate by fixing a toner containing a resin and a hydrocarbon wax;

a mixture layer formation step of forming, on the fixed toner image, a layer of a mixture, the mixture contains at least one selected from the group consisting of diacrylates and dimethacrylates as a component (a) and a polymerization initiator as a component (b); and a resin layer formation step of polymerizing the component (a) and the component (b) in the mixture layer to form the aforementioned resin layer; wherein the melting point of the hydrocarbon wax is from 55° C. to 85° C., the toner image formation step includes a step of forming the fixed toner image, a surface wax index A of the area, as measured by the method described below, is from 0.05 to 0.43, and a wax distribution unevenness index B of the area, as derived using the method described below, is from 0.05 to 0.30;

the surface wax index A is calculated using the following formula (3) from the spectral values obtained by measurement of the FT-IR spectrum using the ATR method and using Ge for the ATR crystal and a condition of 45° for the infrared radiation incidence angle:

$$\text{Surface wax index } A = Pa/Pb \quad (3)$$

where, Pa is the value yielded by subtracting the average value of the absorption intensities at 3050 cm$^{-1}$ and 2600 cm$^{-1}$ from the maximum value of the absorption peak intensity in the range from 2820 cm$^{-1}$ to 2875 cm$^{-1}$, and Pb is the value yielded by subtracting the average value of the absorption intensities at 1800 cm$^{-1}$ and 1650 cm$^{-1}$ from the maximum value of the absorption peak intensity in the range from 1715 cm$^{-1}$ to 1790 cm$^{-1}$;

the wax distribution unevenness index B is given by the following formula (4), where B1 is the number of cells for which the surface wax index A is at least 0.45, as obtained using an ATR-IR/microscope instrument by dividing a 100 μm×100 μm image region on the area into 64×64 cells and calculating the surface wax index A of each cell using formula (3).

$$\text{Wax distribution unevenness index } B = B1/(64\times64) \quad (4)$$

According to the present disclosure, method for producing printed matter that exhibits an excellent low-temperature separation performance during the toner image formation step and an excellent adherence between the varnish and toner image after the execution of a varnish coating, can be obtained.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer to numerical value ranges that include the lower limit and upper limit that are the end points.

When, in the present Specification, numerical value ranges are provided in stages, the upper limits and lower limits of the individual numerical value ranges may be combined in any combination.

The method for producing printed matter includes a toner image formation step of forming a fixed toner image on a substrate by fixing a toner containing a resin and a hydrocarbon wax; a mixture layer formation step of forming, on the fixed toner image, a layer of a mixture, the mixture contains a monomer component; and a resin layer formation step of polymerizing the monomer component in the mixture layer to form a resin layer. Each of the materials and steps is described in the following.

Toner

The toner will be described first. The toner contains at least a resin and a hydrocarbon wax.

Known polymers may be used for the resin, and specifically, for example, the following polymers may be used:

homopolymers of styrene and its substituted forms, e.g., polystyrene, poly-p-chlorostyrene, and polyvinyltoluene; styrene copolymers, e.g., styrene-p-chlorostyrene copolymer, styrene-vinyltoluene copolymer, styrene-vinylnaphthalene copolymer, styrene-acrylate ester copolymers, styrene-methacrylate ester copolymers, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, and styrene-acrylonitrile-indene copolymer; as well as polyvinyl chloride, phenolic resins, natural resin-modified phenolic resins, natural resin-modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, coumarone-indene resins, and petroleum resins. A single one of these resins may be used by itself or two or more may be used in combination.

Polyester resins and styrene copolymers are preferred among the preceding resins. The resin more preferably contains an amorphous polyester resin from the standpoint of the low-temperature separation performance and adherence with the varnish.

The amorphous polyester resin is preferably a condensation polymer from an alcohol component and an acid component. The compounds provided below are examples of the monomers that can produce an amorphous polyester resin.

The alcohol component can be exemplified by a dialcohol component, which is dihydric, as follows:

ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, alkylene (ethylene or propylene) oxide adducts on bisphenol A as represented by formula (I) below, and diols with formula (II) below.

For example, 1,2,3-propanetriol, trimethylolpropane, hexanetriol, pentaerythritol, and so forth may be used in the alcohol component as an at least trihydric polyhydric alcohol.

(I)

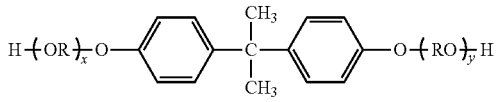

Where, R represents the ethylene group or propylene group, x and y are each integers equal to or greater than 0, and the average value of x+y is from 0 to 10.

(II)

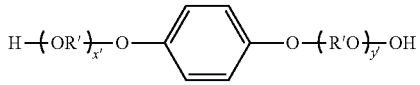

Where, R' is

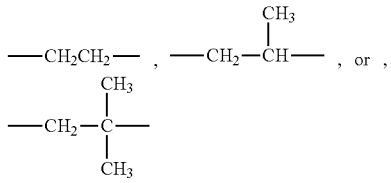

x' and y' are each integers equal to or greater than 0, and the average value of x'+y' is from 0 to 10.

The acid component can be exemplified by divalent carboxylic acids as follows:

benzenedicarboxylic acids and their anhydrides, such as phthalic acid, terephthalic acid, isophthalic acid, and phthalic anhydride; alkyl dicarboxylic acids such as succinic acid, adipic acid, sebacic acid, and azelaic acid, and their anhydrides; succinic acid substituted by an alkyl group having from 6 to 18 carbons or by an alkenyl group having from 6 to 18 carbons, and their anhydrides; and unsaturated dicarboxylic acids such as fumaric acid, maleic acid, citraconic acid, and itaconic acid, and their anhydrides.

The use of an at least trivalent polyvalent carboxylic acid in the acid component is also preferred. Examples are 1,2,4-benzenetricarboxylic acid (trimellitic acid), 1,2,4-cyclohexanetricarboxylic acid, 1,2,4-naphthalenetricarboxylic acid, and pyromellitic acid and their acid anhydrides and lower alkyl esters.

The alcohol component preferably contains a propylene oxide adduct on bisphenol A. This propylene oxide adduct on bisphenol A can be exemplified by polyoxypropylene (2.2)-2,2-bis(4-hydroxyphenyl)propane, polyoxypropylene (3.3)-2,2-bis(4-hydroxyphenyl)propane, polyoxypropylene (2.0)-polyoxyethylene(2.0)-2,2-bis(4-hydroxyphenyl) propane, and polyoxypropylene(6)-2,2-bis(4-hydroxyphenyl)propane.

The content of the amorphous polyester resin in the resin is preferably from 50.0 mass % to 99.9 mass %, more preferably from 80.0 mass % to 99.5 mass %, and still more preferably from 90.0 mass % to 99.5 mass %.

The content of the amorphous polyester resin in the toner is preferably from 50.0 mass % to 95.0 mass %, more preferably from 70.0 mass % to 94.0 mass %, and still more preferably from 80.0 mass % to 93.0 mass %.

The content of structures in which a propylene oxide adduct on bisphenol A is condensed, is preferably from 50 mass % to 100 mass % and more preferably from 70 mass % to 100 mass % of the structures in the amorphous polyester resin in which the dialcohol component is condensed. When this range is obeyed, a favorable interaction is established between the varnish and hydrocarbon wax and the adherence and low-temperature separation performance are improved.

The resin in the toner preferably also contains a crystalline polyester. The crystalline polyester resin preferably has the structure represented in formula (1) below and the structure represented in formula (2) below. A crystalline resin refers to a resin that has a clear and distinct endothermic peak in measurement by differential scanning calorimetry.

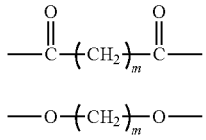

(1)

(2)

Where, m is an integer from 4 to 20 (preferably from 6 to 12) and n is an integer from 4 to 20 (preferably from 6 to 12).

Such a crystalline polyester resin can be obtained using a straight-chain aliphatic dicarboxylic acid having from 6 to 22 carbons as the acid component and a straight-chain aliphatic dialcohol having from 4 to 20 carbons as the alcohol component.

The content of the crystalline polyester in the toner is preferably from 0.1 mass % to 10.0 mass % and is more preferably from 0.5 mass % to 5.0 mass %.

When this range is obeyed, a favorable substrate/toner interaction at low temperatures and a favorable toner/varnish interaction are established due to the crystalline polyester, and the low-temperature separation performance and adherence by the varnish are then enhanced.

The toner contains a hydrocarbon wax. The hydrocarbon wax is, for example, at least one selected from the group consisting of low molecular weight polyethylenes, low molecular weight polypropylenes, microcrystalline waxes, paraffin waxes, Fischer-Tropsch waxes, and so forth. The hydrocarbon wax is preferably at least one selected from the group consisting of microcrystalline waxes and paraffin waxes.

The content of the hydrocarbon wax in the toner is preferably from 1.0 mass % to 7.0 mass % and is more preferably from 2.0 mass % to 6.0 mass %. When this range is obeyed, a favorable separation performance due to the wax and a favorable varnish/wax interaction are established and the low-temperature separation performance and adherence by the image to the varnish are then enhanced.

The melting point of the hydrocarbon wax must be from 55° C. to 85° C. It is preferably from 70° C. to 80° C. The low-temperature separation performance is enhanced by observing this range.

The method for measuring the melting point is as follows.

The measurement is performed in accordance with ASTM D 3418-82 using a "Q2000" differential scanning calorimeter (TA Instruments). Temperature correction in the instrument detection section is performed using the melting points of indium and zinc, and the amount of heat is corrected using the heat of fusion of indium.

Specifically, approximately 3 mg of the sample is exactly weighed out and introduced into an aluminum pan, and the measurement is performed under the following conditions using an empty aluminum pan for reference.

ramp rate: 10° C./min measurement start temperature: 30° C.

measurement end temperature: 180° C.

The melting point is taken to be the peak temperature of the endothermic peak in the resulting DSC curve.

The toner may contain a colorant on an optional basis. The colorant can be exemplified by the following.

Black colorants can be exemplified by carbon black and by colorants provided by color mixing using a yellow colorant, magenta colorant, and cyan colorant to give a black color. A pigment may be used by itself for the colorant or the combination of a pigment and dye may be used. The use of a dye/pigment combination is preferred from the standpoint of the quality of the full-color image.

Pigments for magenta toners can be exemplified by the following: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Red 1, 2, 10, 13, 15, 23, 29, and 35.

Dyes for magenta toners can be exemplified by the following: oil-soluble dyes such as C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; and C.I. Disperse Violet 1, and by basic dyes such as C.I. Basic Red 1, 2, 9, 12, 13, 14, 15, 17, 18, 22, 23, 24, 27, 29, 32, 34, 35, 36, 37, 38, 39, and 40 and C.I. Basic Violet 1, 3, 7, 10, 14, 15, 21, 25, 26, 27, and 28.

Pigments for cyan toners can be exemplified by the following: C.I. Pigment Blue 2, 3, 15:2, 15:3, 15:4, 16, and 17; C.I. Vat Blue 6; C.I. Acid Blue 45; and copper phthalocyanine pigments in which 1 to 5 phthalimidomethyl groups are substituted on the phthalocyanine skeleton.

Dyes for cyan toners can be exemplified by C.I. Solvent Blue 70.

Pigments for yellow toners can be exemplified by the following: C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C.I. Vat Yellow 1, 3, and 20.

Dyes for yellow toners can be exemplified by C.I. Solvent Yellow 162.

A single one of these colorants may be used or a mixture may be used, and these colorants may also be used in a solid solution state. The colorant is selected considering the hue angle, chroma, lightness, lightfastness, OHP transparency, and dispersibility in the toner.

The content of the colorant is preferably from 0.1 mass parts to 30.0 mass parts per 100 mass parts of the resin.

The toner may contain inorganic fine particles on an optional basis. The inorganic fine particles may be internally added to the toner or may be present in the vicinity of the toner surface as an external additive. The inorganic fine particles can be exemplified by fine particles such as silica fine particles, titanium oxide fine particles, alumina fine particles, and fine particles of a titanate salt such as strontium titanate and magnesium titanate, and by composite oxide fine particles of the preceding.

Among the preceding, the toner preferably contains strontium titanate fine particles as an external additive.

The content of the strontium titanate fine particles in the toner is preferably from 0.1 mass % to 10.0 mass %, more preferably from 0.5 mass % to 8.0 mass %, and still more preferably from 0.8 mass % to 6.0 mass %.

The number-average primary particle diameter of the strontium titanate fine particles is preferably from 10 nm to 60 nm and is more preferably from 20 nm to 50 nm.

There are no particular limitations on the method for producing the toner, and known methods, for example, emulsion aggregation methods, pulverization methods, suspension polymerization methods, and so forth, can be used. Pulverization methods are preferred.

Toner Image Formation Step

The toner image formation step is described in the following. The toner image formation step is a step of forming a fixed toner image by fixing the aforementioned toner on a substrate.

The toner preferably is toner used in an image formation method that uses an electrophotographic system, and it is preferably fixed by a heated contact system.

Specifically, using the toner as a developer, for example, a toner image is obtained by the visualization, by charging the developer at a developing apparatus using a triboelectric charging member, of an electrostatic latent image formed electrostatically on an image bearing member; this toner image is transferred to a recording medium; and a fixed toner image is then obtained by subjecting the toner image transferred onto the recording medium to fixing onto the substrate using a heated contact system fixing process.

The substrate can be exemplified by various types, from thin paper to thick paper, e.g., high-quality paper, coated printing paper such as art paper and coated paper, commercial Japanese paper, and postcard paper, as well as plastic films for OHP applications, fabrics, and so forth, but is not limited to the preceding.

The fixation temperature in the toner image formation step is preferably from Tw to Tw+100° C. where Tw (° C.) is the melting point of the hydrocarbon wax, and is more preferably from Tw to Tw+90° C., still more preferably from Tw+50° C. to Tw+90° C., and even more preferably from Tw+60° C. to Tw+80° C. By having the fixation temperature be in the indicated range, the amount and distribution of the hydrocarbon wax present at the toner image surface are then favorable from the standpoint of the low-temperature separation and adherence to the varnish.

The process speed (mm/sec) in the toner image formation step is preferably from 100 to 600 and more preferably from 300 to 500.

The fixed toner image including an area whose toner laid-on level is at least 0.2 mg/cm$^2$, and the toner image formation step includes a step of forming the fixed toner image. The problem with the adherence between the varnish and release agent on the toner image occurs when the laid-on level is 0.2 mg/cm$^2$ or more. This is thought to occur because the proportion for toner that coats the substrate (coverage ratio) then assumes high values. It is thought that the occurrence of this problem is further facilitated in particular with images for which the coverage ratio is at least 90 area %.

The coverage ratio is measured using the following method.

First, the substrate itself used in the evaluation is mounted on an optical microscope (VHX5000, Keyence Corporation), and the amount of light is adjusted in transmission illumination mode so as to provide a suitable brightness area. The toner-bearing image is then mounted in the optical microscope, and the observed image is photographed at the point where measurement is desired. The specific observation conditions are as follows.

magnification: 500× (observed image region: approximately 570 μm×approximately 760 μm)

depth compositing: automatic focus: autofocus

The resulting observed image is binarized by image processing into white background regions and printed regions. The ratio C of the total area of the printed regions to the total area of the observed image is determined. This measurement is carried out at 10 randomly selected points in the image of the toner image, and the arithmetic average value therefrom is used as the coverage ratio.

The surface wax index A of the area must be from 0.05 to 0.43, and the wax distribution unevenness index B of the area must be from 0.05 to 0.30. The toner laid-on level is preferably not more than 1.5 mg/cm$^2$ and is more preferably not more than 1.0 mg/cm$^2$.

The surface wax index A is calculated using the following method. The FT-IR spectrum is measured using the ATR method and using Ge for the ATR crystal and a condition of 45° for the angle of incidence by the infrared radiation. The surface wax index A is calculated using the following formula (3) from the resulting spectral values. The arithmetic average value for sampling at 10 points is used.

$$\text{Surface wax index } A = Pa/Pb \quad (3)$$

[Pa is the value yielded by subtracting the average value of the absorption intensities at 3050 cm$^{-1}$ and 2600 cm$^{-1}$ from the maximum value of the absorption peak intensity in the range from 2820 cm$^{-1}$ to 2875 cm$^{-1}$, and Pb is the value yielded by subtracting the average value of the absorption intensities at 1800 cm$^{-1}$ and 1650 cm$^{-1}$ from the maximum value of the absorption peak intensity in the range from 1715 cm$^{-1}$ to 1790 cm$^{-1}$.]

Pa represents the relative amount of hydrocarbon wax at the toner image surface. The maximum value of the absorption peak intensity in the range from 2820 cm$^{-1}$ to 2875 cm$^{-1}$ primarily represents the amount of absorption originating with the stretching vibration (symmetric) of —CH$^2$— in the hydrocarbon wax.

The reason, in the determination of Pa, for subtracting the average value of the absorption intensities at 3050 cm$^{-1}$ and 2600 cm$^{-1}$ from the maximum value of the absorption peak intensity in the range from 2820 cm$^{-1}$ to 2875 cm$^{-1}$, is to eliminate the influence of the base line and derive the true peak intensity. Since there are no absorption peaks in the vicinity of 3050 cm$^{-1}$ and 2600 cm$^{-1}$, the base line intensity can be calculated by calculating the average value for these two points.

Pb, on the other hand, represents the relative amount of binder resin at the toner image surface. The maximum value of the absorption peak intensity in the range from 1715 cm$^{-1}$ to 1790 cm$^{-1}$ primarily represents the amount of absorption originating with the stretching vibration of —CO— originating from the binder resin.

The reason, in the determination of Pb, for subtracting the average value of the absorption intensities at 1800 cm$^{-1}$ and 1650 cm$^{-1}$ from the maximum value of the absorption peak intensity in the range from 1715 cm$^{-1}$ to 1790 cm$^{-1}$, is to eliminate the influence of the base line and derive the true peak intensity. Since there are no absorption peaks in the vicinity of 1800 $cm^{-1}$ and 1650 $cm^{-1}$, the base line intensity can be calculated by calculating the average value for these two points.

The occurrence ratio of the hydrocarbon wax to the binder resin in the approximately 0.3 μm from the toner image surface can be represented by determining Pa and Pb using ATR-IR and calculating the ratio of Pa to Pb.

The specific procedure for measuring the surface wax index A by the ATR method is as follows.

Measurement is carried out by ATR using a Fourier-transform infrared spectrometer (Spectrum One, PerkinElmer Inc.) equipped with a Universal ATR Sampling Accessory.

The angle of incidence for the infrared light is set to 45°. An ATR crystal of Ge (refractive index=4.0) is used for the ATR crystal. The other conditions are as follows.

wavenumber measurement range: from 600 $cm^{-1}$ to 4000 $cm^{-1}$ number of scans: 16 resolution: 4.00 $cm^{-1}$

The wax distribution unevenness index B is determined using the following method. An ATR-IR/microscope instrument is used; a 100 μm×100 μm image region on the toner image of the image is divided into 64×64 cells; and the wax distribution unevenness index B is then given by formula (4) where B1 is the number of cells for which the surface wax index A is at least 0.45 where the surface wax index A of each cell is calculated using formula (3). The arithmetic average value of 10 image regions is used.

$$\text{Wax distribution unevenness index } B = B1/(64\times64) \quad (4)$$

The specific procedure for measuring the surface wax index A using an ATR-IR/microscope instrument is as follows.

Measurement is performed by the ATR method using a Fourier-transform infrared spectrometer (Spectrum One, PerkinElmer Inc.) equipped with an infrared imaging system (Spotlight 400).

An ATR crystal of Ge (refractive index=4.0) is used as the ATR crystal. The other conditions are as follows.

wavenumber measurement range: from 750 $cm^{-1}$ to 4000 $cm^{-1}$ measurement size: 100 μm×100 μm pixel size: 1.56 number of scans: 2 resolution: 4.00 $cm^{-1}$

The surface wax index A is a relative representation of the amount of hydrocarbon wax present at the toner image surface. The wax distribution unevenness index B, on the other hand, represents the degree of wax localization on a microlevel scale in which the toner image surface has been subjected to a further micropartitioning.

It was found that, when the surface wax index A of the area is from 0.05 to 0.43 and the wax distribution unevenness index B of the area is from 0.05 to 0.30, interaction between the toner image and varnish is preserved and the adherence is enhanced.

The reasons for this are hypothesized to be as follows. The wax distribution unevenness index represents the proportion for regions where at the microlevel the wax has localized at a high concentration. It is thought that a favorable window exists for the wax distribution unevenness index B in order for the low-temperature separation performance to coexist with the adherence between the toner and varnish. It is also thought that the opportunities for contact between the varnish and the resin in the toner are preferably increased in order to bring about an improvement in the adherence between the toner and varnish.

When the wax distribution unevenness index B is less than 0.05, it is thought that the wax has undergone an excessive melting/spreading at the toner image surface, and the opportunities for contact between the varnish and wax are then increased (suppression of contact between the resin and varnish) and as a result the adherence between the toner image and varnish is thereby reduced. It is thought, on the other hand, that when the wax distribution unevenness index B exceeds 0.30, melting/spreading by the wax is then inadequate and the low-temperature separation performance is reduced as a result.

It is thought that, when the surface wax index A is from 0.05 to 0.43 and the wax distribution unevenness index B is brought to from 0.05 to 0.30, a favorable melting/spreading by the wax is established and the low-temperature separation performance and adherence are both increased.

The surface wax index A is preferably from 0.10 to 0.40 and is more preferably from 0.20 to 0.38.

The wax distribution unevenness index B is preferably from 0.07 to 0.20 and is more preferably from 0.10 to 0.15.

The surface wax index A can be controlled through, for example, the amount of wax addition.

The wax distribution unevenness index B can be controlled through, for example, the fixation temperature.

The standard deviation σA for the surface wax index A on the toner image of the image formed in the toner image formation step is preferably not more than 0.05. The standard deviation σB for the wax distribution unevenness index B is preferably not more than 0.05. In addition, the standard deviation σA is more preferably not more than 0.02, and the standard deviation σB is more preferably not more than 0.02.

σA is preferably equal to or greater than 0.000 and is more preferably equal to or greater than 0.005.

σB is preferably equal to or greater than 0.000 and is more preferably equal to or greater than 0.005.

The standard deviation σA and the standard deviation σB are calculated using the following method. The surface wax index A and the wax distribution unevenness index B are each measured at 10 randomly selected points. The standard deviation σA and the standard deviation σB are then calculated by calculating the standard deviation for the values obtained at the 10 points.

The image should have a toner laid-on level of at least 0.2 $mg/cm^2$, but is not otherwise particularly limited. The image preferably contains an image for which the coverage ratio is at least 90 area % and more preferably contains an image for which the coverage ratio is at least 95 area %. The upper limit on this coverage ratio is preferably equal to or less than 100 area %.

Mixture Layer Formation Step

The mixture layer formation step will now be described. The mixture layer formation step is a step of forming, on the fixed toner image, a mixture that contains a monomer component. The monomer component-containing mixture functions as the varnish via execution of the resin layer formation step, infra.

The monomer component-containing mixture is described first. This mixture contains, as a component (a), at least one selected from the group consisting of diacrylates and dimethacrylates. In the following, "(meth)acrylate" means "acrylate and/or methacrylate".

The diacrylates and dimethacrylates can be exemplified by 1,4-butanediol di(meth)acrylate, 1,6-hexanediol di(meth) acrylate, 1,9-nonanediol di(meth)acrylate, neopentyl glycol di(meth)acrylate, diethylene glycol di(meth)acrylate, triethylene glycol di(meth)acrylate, tetraethylene glycol di(meth)acrylate, dipropylene glycol di(meth)acrylate, tripropylene glycol di(meth)acrylate, tetraethylene glycol di(meth)acrylate, polyethylene glycol di(meth)acrylate, and polypropylene glycol di(meth)acrylate.

Among the preceding, the presence of at least one selected from the group consisting of 1,6-hexanediol di(meth)acrylate, dipropylene glycol di(meth)acrylate, and tripropylene glycol di(meth)acrylate is preferred. The presence of at least one selected from the group consisting of dipropylene glycol diacrylate and tripropylene glycol diacrylate is more preferred from the standpoint of the adherence to the resin.

A single one or a plurality of these monomers may be present in the mixture.

The content in the mixture of the at least one selected from the group consisting of diacrylates and dimethacrylates is preferably from 20 mass % to 90 mass % and is more preferably from 40 mass % to 70 mass %.

The mixture may contain the following monomer components on an optional basis:

monofunctional (meth)acrylates such as tetrahydrofurfuryl (meth)acrylate, 2-ethylhexyl (meth)acrylate, 2-hydroxyethyl (meth)acrylate, 2-hydroxypropyl (meth)acrylate, benzyl (meth)acrylate, phenyl glycol mono(meth)acrylate, cyclohexyl (meth)acrylate, and 4-hydroxybutyl (meth)acrylate; polyfunctional (meth)acrylates that are at least trifunctional, e.g., pentaerythritol tri(meth)acrylate, pentaerythritol tetra(meth)acrylate, dipentaerythritol hexa(meth)acrylate, and trimethylolpropane tri(meth)acrylate; silicone compounds into which an acrylic group or methacrylic group has been introduced, e.g., methacrylic-modified silicone and acrylic-modified silicone; and monomer compounds such as N,N-dimethylacrylamide and N-vinylpyrrolidone.

Among the preceding, the mixture preferably contains a monofunctional (meth)acrylate or a polyfunctional (meth) acrylate that is at least trifunctional. Monofunctional and trifunctional refer to the number of (meth)acrylate ester structures.

The content of monofunctional (meth)acrylate in the mixture is preferably from 1 mass % to 30 mass % and is more preferably from 2 mass % to 20 mass %.

The content in the mixture of polyfunctional (meth) acrylate that is at least trifunctional is preferably from 10 mass % to 70 mass % and is more preferably from 20 mass % to 50 mass %.

The aforementioned mixture contains a polymerization initiator as a component (b). The polymerization initiator is preferably a photopolymerization initiator that functions upon exposure to UV.

The photopolymerization initiator can be exemplified by imidazole derivatives such as 2-(o-chlorophenyl)-4,5-diphenylimidazole dimer, 2-(o-chlorophenyl)-4,5-di(methoxyphenyl)imidazole dimer, and 2-(o-fluorophenyl)-4,5-diphenylimidazole dimer; benzophenone derivatives such as benzophenone, N,N'-tetramethyl-4,4'-diaminobenzophenone (Michler's ketone), N,N'-tetraethyl-4,4'-diaminobenzophenone, 4-methoxy-4'-dimethylaminobenzophenone, 4-chlorobenzophenone, 4,4'-dimethoxybenzophenone, and 4,4'-diaminobenzophenone; α-amino aromatic ketone derivatives such as 2-benzyl-2-dimethylamino-1-(4-morpholinophenyl)butan-1-one and 2-methyl-1-[4-(methylthio)phenyl]-2-morpholinopropan-1-one; quinones such as 2-ethylanthraquinone, phenanthrenequinone, 2-t-butylanthraquinone, octamethylanthraquinone, 1,2-benzanthraquinone, 2,3-benzanthraquinone, 2-phenylanthraquinone, 2,3-diphenylanthraquinone, 1-chloroanthraquinone, 2-methylanthraquinone, 1,4-naphthoquinone, 9,10-phenanthraquinone, 2-methyl-1,4-naphthoquinone, and 2,3-dimethylanthraquinone; benzoin ether derivatives such as benzoin methyl ether, benzoin ethyl ether, and benzoin phenyl ether; benzoin derivatives such as benzoin, methylbenzoin, ethylbenzoin, and propylbenzoin; benzyl derivatives such as benzyl dimethyl ketal; acridine derivatives such as 9-phenylacridine and 1,7-bis(9,9'-acrydinyl)heptane; N-phenylglycine derivatives such as N-phenylglycine; acetophenone derivatives such as acetophenone, 3-methylacetophenone, acetophenone benzyl ketal, 1-hydroxycyclohexyl phenyl ketone, and 2,2-dimethoxy-2-phenylacetophenone; thioxanthone derivatives such as thioxanthone, diethylthioxanthone, 2-isopropylthioxanthone, and 2-chlorothioxanthone; acylphosphine oxide derivatives such as 2,4,6-trimethylbenzoyldiphenylphosphine oxide, bis(2,4,6-trimethylbenzoyl)phenylphosphine oxide, and bis(2,6-dimethoxybenzoyl)-2,4,4-trimethylpentylphoephine oxide; oxime ester derivatives such as 1-[4-(phenylthio)phenyl]-1,2-octanedione 2-(O-benzoyloxime) and 1-[9-ethyl-6-(2-methylbenzoyl)-9H-carbazol-3-yl]ethanone 1-(O-acetyloxime); as well as xanthone, fluorenone, benzaldehyde, fluorene, anthraquinone, triphenylamine, carbazole, 1-(4-isopropylphenyl)-2-hydroxy-2-methylpropan-1-one, 2-hydroxy-2-methyl-1-phenylpropan-1-one, and so forth.

The polymerization initiator preferably contains at least one selected from the group consisting of benzophenone and benzophenone derivatives. The content of the polymerization initiator in the mixture is preferably from 1 mass % to 30 mass % and is more preferably from 2 mass % to 20 mass %.

In addition to the components described above, the mixture may contain a photosensitizer, surfactant, polymerization inhibitor, additive, photostabilizer, viscosity modifier, and so forth.

The procedure for forming the layer of the monomer component-containing mixture on the fixed toner image is described in the following.

The mixture layer is formed either immediately after production of the toner image in the toner image formation step or after a holding period after production. The mixture layer may be formed over a portion of the substrate or over the entire substrate.

There are no particular limitations on the method for forming the mixture layer, and, for example, a flexo coater, roll coater, gravure coater, gravure offset coater, bar coater, offset press, sheet-fed press inline varnish coater, or screen printer can be used.

Resin Layer Formation Step

The resin layer formation step is described in the following. The resin layer formation step is a step of polymerizing the monomer component in the aforementioned mixture layer to form a resin layer. This resin layer functions as the varnish.

Known procedures can be used as the polymerization method; however, in a preferred method the monomer is polymerized through the generation of radicals from the polymerization initiator upon exposure to UV. The UV light source is not particularly limited, and, for example, low-pressure mercury lamps, high-pressure mercury lamps, ultrahigh-pressure mercury lamps, metal halide lamps, xenon lamps, electrodeless discharge lamps, LED-UV lamps, and carbon arc lamps can be used.

The average thickness of the resin layer is preferably from 1.0 μm to 10.0 μm, more preferably from 2.0 μm to 8.0 μm, and still more preferably from 3.0 μm to 7.0 μm. The resin layer thickness is measured by sectioning the obtained printed matter in cross section and carrying out measurement on the cross-sectional image of the resin layer using a scanning electron microscope (SEM); the arithmetic average value for 10 points is used.

EXAMPLES

The method for producing printed matter is described in additional detail in the following using examples and comparative examples, but the present disclosure is not limited to or by these.

Unless specifically indicated otherwise, the "parts" and "%" in the following formulations indicate, respectively, "mass parts" and "mass %".

Toner 1 Production Example polyester resin 1 88.0 parts
[composition (mol %) [polyoxypropylene(2.2)-2,2-bis(4-hydroxyphenyl)propane:terephthalic acid:dodecylsuccinic acid:trimellitic acid=100:80:5:15], Mw=70,000, Mw/Mn=31]
crystalline polyester 1.0 parts
[composition (mol %) [1,9-nonanediol:sebacic acid=100:100], Mw=16,000, Mw/Mn=3]
hydrocarbon wax 1 4.0 parts
[paraffin wax, melting point: 75° C.]
C.I. Pigment Blue 15:3 5.0 parts These materials were mixed using a Henschel mixer (Model FM-75, Mitsui Mining Co., Ltd.) at a rotation rate of 20 $s^{-1}$ and a rotation time of 5 minutes, followed by kneading using a twin-screw kneader (Model PCM-30, Ikegai Corporation) set to a temperature of 130° C. The resulting kneaded material was cooled and coarsely pulverized to 1 mm and smaller using a hammer mill to obtain a coarsely pulverized material. The resulting coarsely pulverized material was finely pulverized using a mechanical pulverizer (T-250, Turbo Kogyo Co., Ltd.).

Classification was additionally carried out using a Faculty F-300 (Hosokawa Micron Corporation) to obtain toner particle 1. The operating conditions were a classification rotor rotation rate of 130 $s^{-1}$ and a dispersion rotor rotation rate of 120 $s^{-1}$.

Toner 1 was obtained by mixing the following into 98.0 parts of toner particle 1 using a Henschel mixer (Model FM-75, Mitsui Miike Chemical Engineering Machinery Co., Ltd.) at a rotation rate of 30 $s^{-1}$ for a rotation time of 10 minutes: 1.0 parts of a hydrophobic silica (BET: 200 $m^2/g$) and 1.0 parts of strontium titanate fine particles (surface-treated with 3,3,3-trifluoropropyldimethoxysilane, number-average primary particle diameter=35 nm). The weight-average particle diameter (D4) of toner 1 was 6.5 μm.

Toner 2 Production Example

Toner 2 was obtained by carrying out the same procedure as in the Toner 1 Production Example, but changing the strontium titanate fine particles in the Toner 1 Production Example to titanium oxide fine particles (surface-treated with isobutyltrimethoxysilane, BET surface area=80 $m^2/g$).

Toners 3, 6 to 9, 14, and 15 Production Example

Toners 3, 6 to 9, 14, and 15 were obtained by carrying out the same procedure as in the Toner 1 Production Example, but changing the number of parts of the polyester resin 1, crystalline polyester, and hydrocarbon wax 1 in the Toner 1 Production Example as indicated in Table 1.

Toner 4 Production Example

Toner 4 was obtained by carrying out the same procedure as in the Toner 1 Production Example, but changing the polyester resin 1 in the Toner 1 Production Example to polyester resin 2 [composition (mol %) [polyoxyethylene (2.2)-2,2-bis(4-hydroxyphenyl)propane:polyoxypropylene (2.2)-2,2-bis(4-hydroxyphenyl)propane:terephthalic acid:dodecylsuccinic acid:trimellitic acid=40:60:80:5:15], Mw=68,000, Mw/Mn=30].

Toner 5 Production Example

Toner 5 was obtained by carrying out the same procedure as in the Toner 1 Production Example, but changing the polyester resin 1 in the Toner 1 Production Example to polyester resin 3 [composition (mol %) [polyoxyethylene (2.2)-2,2-bis(4-hydroxyphenyl)propane:polyoxypropylene (2.2)-2,2-bis(4-hydroxyphenyl)propane:terephthalic acid:dodecylsuccinic acid:trimellitic acid=60:40:80:5:15], Mw=68,000, Mw/Mn=30].

Toner 10 Production Example

Toner 10 was obtained by carrying out the same procedure as in the Toner 1 Production Example, but changing the polyester resin 1 in the Toner 1 Production Example to a styrene-acrylic resin [composition (mol %) [styrene:n-butyl acrylate:acrylic acid=76:22:2], Mw=51,000, Mw/Mn=3].

Toner 11 Production Example

Toner 11 was obtained by carrying out the same procedure as in the Toner 1 Production Example, but changing the hydrocarbon wax 1 in the Toner 1 Production Example to hydrocarbon wax 2 [paraffin wax, melting point: 60° C.].

Toner 12 Production Example

Toner 12 was obtained by carrying out the same procedure as in the Toner 1 Production Example, but changing the hydrocarbon wax 1 in the Toner 1 Production Example to hydrocarbon wax 3 [microcrystalline wax, melting point: 80° C.].

Toner 13 Production Example

Toner 13 was obtained by carrying out the same procedure as in the Toner 1 Production Example, but changing the hydrocarbon wax 1 in the Toner 1 Production Example to hydrocarbon wax 4 [microcrystalline wax, melting point: 90° C.].

TABLE 1

| Toner | | | | | | | | | | | | | | | |
|---|---|---|---|---|---|---|---|---|---|---|---|---|---|---|---|
| | particle dia- | Resin | | | | | Release agent | | | Colorant | | Inorganic fine parlicles | | | |
| | | | | PO | | | | | Melting | | | | | | |
| Number | meter [μm] | Type | amount % | ratio % | Type | amount % | Type | amount % | point [° C.] | Type | amount % | Type | amount % | Type | amount % |
| Toner 1 | 6.5 | Poly-ester 1 | 88.0 | 100 | Crystal-line polyester | 1.0 | Hydro-carbon wax 1 | 4.0 | 75 | Cyan pig-ment | 5.0 | Silica | 1.0 | Sr titanate | 1.0 |
| Toner 2 | 6.5 | Poly-ester 1 | 88.0 | 100 | Crystal-line polyester | 1.0 | Hydro-carbon wax 1 | 4.0 | 75 | Cyan pig-ment | 5.0 | Silica | 1.0 | Titan-ium oxide | 1.0 |
| Toner 3 | 6.5 | Poly-ester 1 | 89.0 | 100 | Crystal-line polyester | 0 | Hydro-carbon wax 1 | 4.0 | 75 | Cyan pig-ment | 5.0 | Silica | 1.0 | Sr titanate | 1.0 |
| Toner 4 | 6.5 | Poly-ester 2 | 88.0 | 63 | Crystal-line polyester | 1.0 | Hydro-carbon wax 1 | 4.0 | 75 | Cyan pig-ment | 5.0 | Silica | 1.0 | Sr titanate | 1.0 |
| Toner 5 | 6.5 | Poly-ester 3 | 88.0 | 43 | Crystal-line polyester | 1.0 | Hydro-carbon wax 1 | 4.0 | 75 | Cyan pig-ment | 5.0 | Silica | 1.0 | Sr titanate | 1.0 |
| Toner 6 | 6.5 | Poly-ester 1 | 91.2 | 100 | Crystal-line polyester | 1.0 | Hydro-carbon wax 1 | 0.8 | 75 | Cyan pig-ment | 5.0 | Silica | 1.0 | Sr titanate | 1.0 |
| Toner 7 | 6.5 | Poly-ester 1 | 90.5 | 100 | Crystal-line polyester | 1.0 | Hydro-carbon wax 1 | 1.5 | 75 | Cyan pig-ment | 5.0 | Silica | 1.0 | Sr titanate | 1.0 |
| Toner 8 | 6.5 | Poly-ester 1 | 85.5 | 100 | Crystal-line polyester | 1.0 | Hydro-carbon wax 1 | 6.5 | 75 | Cyan pig-ment | 5.0 | Silica | 1.0 | Sr titanate | 1.0 |
| Toner 9 | 6.5 | Poly-ester 1 | 84.5 | 100 | Crystal-line polyester | 1.0 | Hydro-carbon wax 1 | 7.5 | 75 | Cyan pig-ment | 5.0 | Silica | 1.0 | Sr titanate | 1.0 |
| Toner 10 | 6.5 | sty-rene acrylic 1 | 88.0 | 0 | Crystal-line polyester | 1.0 | Hydro-carbo wax 1 | 4.0 | 75 | Cyan pig-ment | 5.0 | Silica | 1.0 | Sr titanate | 1.0 |
| Toner 11 | 6.5 | Poly-ester 1 | 88.0 | 100 | Crystal-line polyester | 1.0 | Hydro-carbon wax 1 | 4.0 | 60 | Cyan pig-ment | 5.0 | Silica | 1.0 | Sr titanate | 1.0 |
| Toner 12 | 6.5 | Poly-ester 1 | 88.0 | 100 | Crystal-line polyester | 1.0 | Hydro-carbon wax 1 | 4.0 | 80 | Cyan pig-ment | 5.0 | Silica | 1.0 | Sr titanate | 1.0 |
| Toner 13 | 6.5 | Poly-ester 1 | 88.0 | 100 | Crystal-line polyester | 1.0 | Hydro-carbon wax1 | 4.0 | 90 | Cyan pig-ment | 5.0 | Silica | 1.0 | Sr titanate | 1.0 |
| Toner 14 | 6.5 | Poly-ester 1 | 91.9 | 100 | Crystal-line polyester | 1.0 | Hydro-carbon wax 1 | 0.1 | 75 | Cyan pig-ment | 5.0 | Silica | 1.0 | Sr titanate | 1.0 |
| Toner 15 | 6.5 | Poly-ester 1 | 82.0 | 100 | Crystal-line polyester | 1.0 | Hydro-carbon wax 1 | 10.0 | 75 | Cyan pig-ment | 5.0 | Silica | 1.0 | Sr titanate | 1.0 |

In the table, the amounts are given in mass % and the PO ratio (mass %) refers to the content of the structure in which the bisphenol A/propylene oxide adduct is condensed, in the structures in the amorphous polyester resin in which the dialcohol component is condensed.

Example 1

Evaluation of Low-Temperature Separation Performance in Toner Image Formation Step A developer 1 was prepared by mixing toner 1 with a ferrite carrier surface-coated with silicone resin (average particle diameter=42 μm) so as to provide a toner concentration of 8 mass %.

A modified version of an imageRUNNER ADVANCE C9280 PRO, a digital printer for commercial printing from Canon, Inc., was used as the image-forming apparatus.

The modifications made it possible to freely set the direct-current voltage VDC of the developer carrying member, the charging voltage VD of the electrostatic latent image bearing member, the laser power, the fixation temperature, and the process speed. An FFh image (solid image) with the desired image ratio was output in the image output evaluation. FFh is a value that represents 256 gradations in hexadecimal format, wherein 00h is the 1st gradation (white background region) of the 256 gradations and FFh is the 256th gradation (solid region) of the 256 gradations.

The fixed toner image was obtained using this apparatus and the following conditions.

substrate: A4 CS-680 paper (68.0 g/m$^2$)

(sold by Canon Marketing Japan Inc.)

evaluation image: a 60 mm-wide image placed at a position 4 mm from the leading edge of the aforementioned A4 paper toner laid-on level: 1.20 mg/cm$^2$ fixation temperature: 150° C.

process speed: 500 mm/sec test environment: low-temperature, low-humidity environment: temperature of 15° C./humidity of 10% RH ("L/L" below)

The aforementioned evaluation image was output and the low-temperature separation performance (low-temperature fixability) was evaluated. The value of the percentage reduction in image density was used as the index for evaluating the low-temperature fixability. The percentage reduction in image density is measured using an X-Rite color reflection densitometer (500 Series, X-Rite, Incorporated), and the image density in the center region is measured first.

The fixed image is then rubbed (5 back-and-forth excursions) in the region where the image density has been measured, using lens-cleaning paper while applying a load of 4.9 kPa (50 g/cm$^2$), and the image density is re-measured. The percentage reduction in the image density pre-versus-post-rubbing was calculated using the formula given below. The obtained percentage reduction in image density was evaluated using the evaluation criteria given below. A C or better was regarded as good.

percentage reduction in image density=(image density pre-rubbing−image density post-rubbing)/image density pre-rubbing×100

A lower percentage reduction in image density indicates a better separability (fixability) for the image.

Evaluation Criteria

A: the percentage reduction in image density is less than 5.0%

B: the percentage reduction in image density is from 5.0% to less than 7.0%

C: the percentage reduction in image density is from 7.0% to less than 10.0%

D: the percentage reduction in image density is at least 10.0%, or cannot be evaluated Evaluation of Varnish Adherence Using the previously described image-forming apparatus, the conditions described below, toner 1, and the aforementioned instrumentation, a fixed toner image 1 for varnish coating was obtained under the following conditions.

substrate: OK Top Coat Plus A4 paper (127.9 g/m$^2$) (Oji Paper Co., Ltd.)

evaluation image: A4 paper whole-side solid image toner laid-on level: 0.4 mg/cm$^2$ fixation temperature: 150° C.

process speed: 350 mm/sec

The coverage ratio for this fixed toner image 1 for varnish coating was 100 area %; the surface wax index A was 0.37; the wax distribution unevenness index B was 15; the standard deviation σA was 0.01; and the standard deviation σB was 0.01.

A monomer mixture for forming the varnish was then produced using the following method.

A monomer mixture 1 was obtained by mixing 50 parts of tripropylene glycol diacrylate, 20 parts of trimethylolpropane triacrylate, 10 parts of pentaerythritol tetraacrylate, 5 parts of phenyl glycol monoacrylate, and 15 parts of benzophenone as a photopolymerization initiator and stirring with a mixer.

Using a bar coater, the monomer mixture 1 was then coated in a thickness of 5 μm on the toner image 1 for varnish coating. This was followed by exposure to ultraviolet radiation using a high-pressure mercury lamp at a cumulative light amount at the image surface of from 120 mJ/cm$^2$ to 130 mJ/cm$^2$, to form a resin layer (varnish layer) on the fixed toner image.

The adherence between the varnish and toner image was then evaluated. The adherence between the varnish and toner image was evaluated using the scratch hardness (pencil method), which is standardized in JIS K 5600-5-4. A higher scratch hardness was taken to indicate a higher adherence between the toner and varnish.

Evaluation Criteria

A: the scratch hardness is at least 5H

B: the scratch hardness is from 3H to less than 5H

C: the scratch hardness is from H to less than 3H

D: the scratch hardness is from HB to less than H

E: the scratch hardness is B or less, or cannot be evaluated

Evaluations in Examples 2 to 22 and Comparative Examples 1 to 7

The low-temperature separation performance was evaluated as in Example 1 using the different toners. The parameters of the evaluation are given in Table 2, and the results are given in Table 5.

The varnish adherence was evaluated as in the evaluation of Example 1, but changing the toner and the type of varnish, fixing conditions, and varnish coating conditions. The details of the toner image formation step are given in Table 3; the details of the mixture layer formation step and resin layer formation step are given in Table 4; and the results are given in Table 5.

In Comparative Example 6, the image wrapped around the fixing unit in the evaluation of the low-temperature separation performance, and separation did not occur and the evaluation could not be carried out as a consequence. The varnish adherence could likewise not be evaluated because the image did not separate from the fixing unit. With regard to the surface wax index A and the wax distribution unevenness index B, these were measured after forcibly peeling the image from the fixing unit.

TABLE 2

| | | Parameters for the low-temperature separation | | |
|---|---|---|---|---|
| | Toner used | Laid-on level [mg/cm$^2$] | Fixation temperature [° C.] | Process speed [mm/sec] |
| Example 1 | Toner 1 | 1.2 | 150 | 500 |
| Example 2 | Toner 1 | 1.2 | 150 | 500 |
| Example 3 | Toner 2 | 1.2 | 150 | 500 |
| Example 4 | Toner 3 | 1.2 | 150 | 500 |
| Example 5 | Toner 1 | 1.2 | 150 | 500 |
| Example 6 | Toner 1 | 1.2 | 150 | 500 |
| Example 7 | Toner 1 | 1.2 | 150 | 500 |
| Example 8 | Toner 1 | 1.2 | 150 | 500 |
| Example 9 | Toner 1 | 1.2 | 150 | 500 |
| Example 10 | Toner 4 | 1.2 | 150 | 500 |
| Example 11 | Toner 5 | 1.2 | 150 | 500 |
| Example 12 | Toner 6 | 1.2 | 150 | 500 |
| Example 13 | Toner 7 | 1.2 | 150 | 500 |
| Example 14 | Toner 8 | 1.2 | 150 | 500 |
| Example 15 | Toner 9 | 1.2 | 150 | 500 |
| Example 16 | Toner 10 | 1.2 | 150 | 500 |
| Example 17 | Toner 11 | 1.2 | 150 | 500 |
| Example 18 | Toner 12 | 1.2 | 150 | 500 |
| Example 19 | Toner 1 | 1.2 | 150 | 500 |
| Example 20 | Toner 1 | 1.2 | 150 | 500 |
| Example 21 | Toner 1 | 1.2 | 150 | 500 |

TABLE 2-continued

| | Toner used | Parameters for the low-temperature separation | | |
|---|---|---|---|---|
| | | Laid-on level [mg/cm$^2$] | Fixation temperature [° C.] | Process speed [mm/sec] |
| Example 22 | Toner 1 | 1.2 | 150 | 500 |
| Comparative Example 1 | Toner 1 | 1.2 | 150 | 500 |
| Comparative Example 2 | Toner 13 | 1.2 | 150 | 500 |
| Comparative Example 3 | Toner 1 | 1.2 | 150 | 500 |
| Comparative Example 4 | Toner 11 | 1.2 | 150 | 500 |
| Comparative Example 5 | Toner 9 | 1.2 | 150 | 500 |
| Comparative Example 6 | Toner 14 | 1.2 | 150 | 500 |
| Comparative Example 7 | Toner 15 | 1.2 | 150 | 500 |

The laid-on level in the table is the toner laid-on level.

TABLE 3

| | Toner used | Parameters for the evaluation of varnish adherence Toner image formation step | | | | | | | |
|---|---|---|---|---|---|---|---|---|---|
| | | Laid-on level [mg/cm$^2$] | Fixation temp. [° C.] | Process speed [mm/sec] | Coverage ratio [%] | Surface wax index A | Wax distribution unevenness index B | σA | σB |
| Example 1 | Toner 1 | 0.4 | 150 | 350 | 100 | 0.37 | 0.15 | 0.01 | 0.01 |
| Example 2 | Toner 1 | 0.4 | 150 | 350 | 100 | 0.37 | 0.15 | 0.01 | 0.01 |
| Example 3 | Toner 2 | 0.4 | 150 | 350 | 100 | 0.37 | 0.15 | 0.01 | 0.01 |
| Example 4 | Toner 3 | 0.4 | 150 | 350 | 100 | 0.37 | 0.15 | 0.01 | 0.01 |
| Example 5 | Toner 1 | 0.4 | 150 | 350 | 100 | 0.37 | 0.15 | 0.01 | 0.01 |
| Example 6 | Toner 1 | 0.4 | 150 | 350 | 100 | 0.37 | 0.15 | 0.01 | 0.01 |
| Example 7 | Toner 1 | 0.4 | 150 | 350 | 100 | 0.37 | 0.15 | 0.01 | 0.01 |
| Example 8 | Toner 1 | 0.4 | 150 | 350 | 100 | 0.37 | 0.15 | 0.01 | 0.01 |
| Example 9 | Toner 1 | 0.4 | 150 | 350 | 100 | 0.37 | 0.15 | 0.01 | 0.01 |
| Example 10 | Toner 4 | 0.4 | 150 | 350 | 100 | 0.37 | 0.15 | 0.01 | 0.01 |
| Example 11 | Toner 5 | 0.4 | 150 | 350 | 100 | 0.37 | 0.15 | 0.01 | 0.01 |
| Example 12 | Toner 6 | 0.4 | 150 | 350 | 100 | 0.11 | 0.06 | 0.01 | 0.01 |
| Example 13 | Toner 7 | 0.4 | 150 | 350 | 100 | 0.17 | 0.08 | 0.01 | 0.01 |
| Example 14 | Toner 8 | 0.4 | 145 | 350 | 100 | 0.40 | 0.20 | 0.01 | 0.01 |
| Example 15 | Toner 9 | 0.4 | 140 | 350 | 100 | 0.42 | 0.24 | 0.01 | 0.01 |
| Example 16 | Toner 10 | 0.4 | 140 | 350 | 100 | 0.37 | 0.15 | 0.01 | 0.01 |
| Example 17 | Toner 11 | 0.4 | 140 | 350 | 100 | 0.37 | 0.10 | 0.01 | 0.01 |
| Example 18 | Toner 12 | 0.4 | 140 | 350 | 100 | 0.37 | 0.19 | 0.01 | 0.01 |
| Example 19 | Toner 1 | 0.4 | 160 | 350 | 100 | 0.42 | 0.10 | 0.01 | 0.01 |
| Example 20 | Toner 1 | 0.8 | 160 | 350 | 100 | 0.37 | 0.11 | 0.01 | 0.01 |
| Example 21 | Toner 1 | 1.2 | 170 | 350 | 100 | 0.37 | 0.08 | 0.01 | 0.01 |
| Example 22 | Toner 1 | 0.2 | 170 | 350 | 95 | 0.37 | 0.08 | 0.01 | 0.01 |
| Comparative Example 1 | Toner 1 | 0.4 | 140 | 350 | 100 | 0.37 | 0.15 | 0.01 | 0.01 |
| Comparative Example 2 | Toner 13 | 0.4 | 140 | 350 | 100 | 0.37 | 0.22 | 0.01 | 0.01 |
| Comparative Example 3 | Toner 1 | 0.4 | 170 | 350 | 100 | 0.45 | 0.08 | 0.01 | 0.01 |
| Comparative Example 4 | Toner 11 | 0.4 | 160 | 350 | 100 | 0.42 | 0.03 | 0.01 | 0.01 |
| Comparative Example 5 | Toner 9 | 0.4 | 150 | 350 | 100 | 0.47 | 0.14 | 0.01 | 0.01 |
| Comparative Example 6 | Toner 14 | 0.4 | 150 | 350 | 100 | 0.03 | 0.00 | 0.01 | 0.00 |
| Comparative Example 7 | Toner 15 | 0.4 | 140 | 350 | 100 | 0.52 | 0.32 | 0.01 | 0.00 |

The coverage ratio in the table represents area %.

TABLE 4

| | Parameters for the evaluation of varnish adherence Mixture layer formation step and resin layer formation step | | | | | | | | | | |
|---|---|---|---|---|---|---|---|---|---|---|---|
| | Monomer 1 | | Monomer 2 | | Monomer 3 | | Monomer 4 | | Photopolymerization initiator | | Resin layer thickness |
| | Type | Parts | Type | Parts | Type | Parts | Type | Parts | Type | Parts | [μm] |
| Example 1 | TPGDA | 50 | TMPTA | 20 | PETA | 10 | PGA | 5 | BP | 15 | 5 |
| Example 2 | DPGDA | 50 | TMPTA | 20 | PETA | 10 | PGA | 5 | BP | 15 | 5 |
| Example 3 | TPGDA | 50 | TMPTA | 20 | PETA | 10 | PGA | 5 | BP | 15 | 5 |
| Example 4 | TPGDA | 50 | TMPTA | 20 | PETA | 10 | PGA | 5 | BP | 15 | 5 |
| Example 5 | HDDA | 50 | TMPTA | 20 | PETA | 10 | PGA | 5 | BP | 15 | 5 |
| Example 6 | TPGDA | 50 | TMPTA | 20 | PETA | 10 | PGA | 5 | BP | 15 | 0.8 |
| Example 7 | TPGDA | 50 | TMPTA | 20 | PETA | 10 | PGA | 5 | BP | 15 | 1.5 |
| Example 8 | TPGDA | 50 | TMPTA | 20 | PETA | 10 | PGA | 5 | BP | 15 | 9 |
| Example 9 | TPGDA | 50 | TMPTA | 20 | PETA | 10 | PGA | 5 | BP | 15 | 10.5 |
| Example 10 | TPGDA | 50 | TMPTA | 20 | PETA | 10 | PGA | 5 | BP | 15 | 5 |
| Example 11 | TPGDA | 50 | TMPTA | 20 | PETA | 10 | PGA | 5 | BP | 15 | 5 |
| Example 12 | TPGDA | 50 | TMPTA | 20 | PETA | 10 | PGA | 5 | BP | 15 | 5 |
| Example 13 | TPGDA | 50 | TMPTA | 20 | PETA | 10 | PGA | 5 | BP | 15 | 5 |
| Example 14 | TPGDA | 50 | TMPTA | 20 | PETA | 10 | PGA | 5 | BP | 15 | 5 |
| Example 15 | TPGDA | 50 | TMPTA | 20 | PETA | 10 | PGA | 5 | BP | 15 | 5 |
| Example 16 | TPGDA | 50 | TMPTA | 20 | PETA | 10 | PGA | 5 | BP | 15 | 5 |
| Example 17 | TPGDA | 50 | TMPTA | 20 | PETA | 10 | PGA | 5 | BP | 15 | 5 |
| Example 18 | TPGDA | 50 | TMPTA | 20 | PETA | 10 | PGA | 5 | BP | 15 | 5 |
| Example 19 | TPGDA | 50 | TMPTA | 20 | PETA | 10 | PGA | 5 | BP | 15 | 5 |
| Example 20 | TPGDA | 50 | TMPTA | 20 | PETA | 10 | PGA | 5 | BP | 15 | 5 |
| Example 21 | TPGDA | 50 | TMPTA | 20 | PETA | 10 | PGA | 5 | BP | 15 | 5 |
| Example 22 | TPGDA | 50 | TMPTA | 20 | PETA | 10 | PGA | 5 | BP | 15 | 5 |
| Comparative Example 1 | | | TMPTA | 40 | PETA | 40 | PGA | 5 | BP | 15 | 5 |
| Comparative Example 2 | TPGDA | 50 | TMPTA | 20 | PETA | 10 | PGA | 5 | BP | 15 | 5 |
| Comparative Example 3 | TPGDA | 50 | TMPTA | 20 | PETA | 10 | PGA | 5 | BP | 15 | 5 |
| Comparative Example 4 | TPGDA | 50 | TMPTA | 20 | PETA | 10 | PGA | 5 | BP | 15 | 5 |
| Comparative Example 5 | TPGDA | 50 | TMPTA | 20 | PETA | 10 | PGA | 5 | BP | 15 | 5 |
| Comparative Example 6 | TPGDA | 50 | TMPTA | 20 | PETA | 10 | PGA | 5 | BP | 15 | 5 |
| Comparative Example 7 | TPGDA | 50 | TMPTA | 20 | PETA | 10 | PGA | 5 | BP | 15 | 5 |

The abbreviations in Table 4 represent the following.
TPGDA: tripropylene glycol diacrylate
DPGDA: dipropylene glycol diacrylate
HDDA: 1,6-hexanediol diacrylate
TMPTA: trimethylolpropane triacrylate
PETA: pentaerythritol tetraacrylate
PGA: phenyl glycolmonoacrylate
BP: benzophenone

TABLE 5

| | | Low-temperature separation performance | | | |
|---|---|---|---|---|---|
| | | Percentage reduction | | Adherence with the varnish | |
| | Toner used | in image density [%] | Evaluation rank | Scratch hardness | Evaluation rank |
| Example 1 | Toner 1 | 4.5 | A | 5H | A |
| Example 2 | Toner 1 | 4.5 | A | 5H | A |
| Example 3 | Toner 2 | 4.6 | A | 4H | B |
| Example 4 | Toner 3 | 5.6 | B | 3H | B |
| Example 5 | Toner 1 | 4.5 | A | 3H | B |
| Example 6 | Toner 1 | 4.5 | A | HB | D |
| Example 7 | Toner 1 | 4.5 | A | 2H | C |
| Example 8 | Toner 1 | 4.5 | A | 4H | B |
| Example 9 | Toner 1 | 4.5 | A | 3H | B |

TABLE 5-continued

| | | Low-temperature separation performance | | | |
|---|---|---|---|---|---|
| | | Percentage reduction | | Adherence with the varnish | |
| | Toner used | in image density [%] | Evaluation rank | Scratch hardness | Evaluation rank |
| Example 10 | Toner 4 | 4.4 | A | 3H | B |
| Example 11 | Toner 5 | 4.2 | A | H | C |
| Example 12 | Toner 6 | 8.1 | C | 5H | A |
| Example 13 | Toner 7 | 6.8 | B | 5H | A |
| Example 14 | Toner 8 | 3.9 | A | 4H | B |
| Example 15 | Toner 9 | 3.6 | A | 3H | B |
| Example 16 | Toner 10 | 7.2 | C | 3H | B |
| Example 17 | Toner 11 | 3.8 | A | 3H | B |
| Example 18 | Toner 12 | 6.8 | B | 5H | A |

TABLE 5-continued

| | | Low-temperature separation performance | | | |
|---|---|---|---|---|---|
| | | Percentage reduction | | Adherence with the varnish | |
| | Toner used | in image density [%] | Evaluation rank | Scratch hardness | Evaluation rank |
| Example 19 | Toner 1 | 4.5 | A | 3H | B |
| Example 20 | Toner 1 | 4.5 | A | 3H | B |
| Example 21 | Toner 1 | 4.5 | A | 2H | C |
| Example 22 | Toner 1 | 4.5 | A | 5H | A |
| Comparative Example 1 | Toner 1 | 4.5 | A | B | E |
| Comparative Example 2 | Toner 13 | 10.5 | D | 5H | A |
| Comparative Example 3 | Toner 1 | 4.5 | A | B | E |
| Comparative Example 4 | Toner 11 | 3.8 | A | B | E |
| Comparative Example 5 | Toner 9 | 3.6 | A | 2B | E |
| Comparative Example 6 | Toner 14 | could not be evaluated | D | could not be evaluated | E |
| Comparative Example 7 | Toner 15 | 3.6 | A | 3B | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-158136, filed Aug. 30, 2019 which is hereby incorporated by reference herein in its entirety.

What is claimed is:

1. A method for producing printed matter that has a fixed toner image and a resin layer, in the indicated sequence, on a substrate, the fixed toner image including an area whose toner laid-on level is at least 0.2 mg/cm$^2$, the method comprising:

a toner image formation step of forming the fixed toner image on the substrate by fixing a toner containing a resin and a hydrocarbon wax;

a mixture layer formation step of forming, on the fixed toner image, a layer of a mixture, the mixture containing:

at least one selected from the group consisting of diacrylates and dimethacrylates as a component (a); and a polymerization initiator as a component (b); and a resin layer formation step of polymerizing the component (a) and the component (b) in the mixture layer to form the resin layer, wherein a melting point of the hydrocarbon wax is from 55° C. to 85° C.;

a surface wax index A of the area is from 0.05 to 0.43; and a wax distribution unevenness index B of the area is from 0.05 to 0.30, wherein the surface wax index A is calculated using formula (3) from spectral values obtained by measurement of an FT-IR spectrum using an ATR method and using Ge for an ATR crystal and a condition of 45° for an infrared radiation incidence angle:

$$\text{surface wax index } A = Pa/Pb \quad (3),$$

where Pa is a value yielded by subtracting an average value of absorption intensities at 3050 cm$^{-1}$ and 2600 cm$^{-1}$ from a maximum value of an absorption peak intensity in a range from 2820 cm$^{-1}$ to 2875 cm$^{-1}$, and Pb is a value yielded by subtracting an average value of the absorption intensities at 1800 cm$^{-1}$ and 1650 cm$^{-1}$ from the maximum value of the absorption peak intensity in a range from 1715 cm$^{-1}$ to 1790 cm$^{-1}$, and wherein the wax distribution unevenness index B is calculated using formula (4):

$$\text{wax distribution unevenness index } B = B1/(64\times64) \quad (4),$$

where B1 is a number of cells for which the surface wax index A is at least 0.45, as obtained using an ATR-IR/microscope instrument by dividing a 100 μm×100 μm image region on an area into 64×64 cells and calculating the surface wax index A of each cell using the formula (3).

2. The method for producing printed matter according to claim 1, wherein a standard deviation σA of the surface wax index A is not more than 0.05 and a standard deviation σB of the wax distribution unevenness index B is not more than 0.05.

3. The method for producing printed matter according to claim 1, wherein the resin contains an amorphous polyester resin.

4. The method for producing printed matter according to claim 3, wherein a content of units of a propylene oxide adduct on bisphenol A is from 50 mass % to 100 mass % of units of dialcohol in the amorphous polyester resin.

5. The method for producing printed matter according to claim 1, wherein a content of the hydrocarbon wax in the toner is from 1.0 mass % to 7.0 mass %.

6. The method for producing printed matter according to claim 1, wherein a fixation temperature in the toner image formation step is from Tw (° C.) to (Tw+100)° C., where Tw (° C.) is the melting point of the hydrocarbon wax.

7. The method for producing printed matter according to claim 1, wherein the polymerization initiator is a photopolymerization initiator.

8. The method for producing printed matter according to claim 1, wherein an average thickness of the resin layer is from 1.0 μm to 10.0 μm.

9. The method for producing printed matter according to claim 1, wherein the component (a) includes at least one selected from the group consisting of dipropylene glycol diacrylate and tripropylene glycol diacrylate.

10. The method for producing printed matter according to claim 1, wherein the resin further contains a crystalline polyester, and wherein a content of the crystalline polyester in the toner is from 0.1 mass % to 10.0 mass %.

11. The method for producing printed matter according to claim 1, wherein the toner contains strontium titanate as an external additive, and wherein a content of the strontium titanate in the toner is from 0.1 mass % to 10.0 mass %.

12. The method for producing printed matter according to claim 1, wherein the fixed toner image includes an image for which a coverage ratio is at least 90 area %.

* * * * *